US009766583B2

(12) United States Patent
Kunimori

(10) Patent No.: US 9,766,583 B2
(45) Date of Patent: Sep. 19, 2017

(54) IMAGE FORMING APPARATUS

(71) Applicant: Oki Data Corporation, Tokyo (JP)

(72) Inventor: Osamu Kunimori, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/974,486

(22) Filed: Dec. 18, 2015

(65) Prior Publication Data

US 2016/0282776 A1 Sep. 29, 2016

(30) Foreign Application Priority Data

Mar. 25, 2015 (JP) ..... 2015-063075

(51) Int. Cl.
*G03G 15/20* (2006.01)
*G03G 15/00* (2006.01)

(52) U.S. Cl.
CPC ..... *G03G 15/6585* (2013.01); *G03G 15/2046* (2013.01); *G03G 2215/0081* (2013.01); *G03G 2215/00447* (2013.01); *G03G 2215/0129* (2013.01)

(58) Field of Classification Search
None
See application file for complete search history.

(56) References Cited

U.S. PATENT DOCUMENTS 6,731,886 B2 * 5/2004 Takeda ..... B41J 11/009 399/45
2006/0198660 A1 * 9/2006 Bessho ..... G03G 15/5062 399/223
2007/0242970 A1 * 10/2007 Fujino ..... G03G 15/2021 399/69
2010/0008683 A1 * 1/2010 Yoshikawa ..... G03G 15/1695 399/45
2013/0101303 A1 * 4/2013 Kasai ..... G03G 15/205 399/45
2016/0116870 A1 * 4/2016 Tanaka ..... G03G 15/205 399/69

FOREIGN PATENT DOCUMENTS

JP 2010152209 A * 7/2010
JP 2013142893 A * 7/2013
JP 2014-106413 A 6/2014

OTHER PUBLICATIONS

Machine translation of Watanabe (2010).*

* cited by examiner

*Primary Examiner* — Sevan A Aydin
(74) *Attorney, Agent, or Firm* — Muncy, Geissler, Olds & Lowe, P.C.

(57) ABSTRACT

An image forming apparatus includes a first image forming unit that develops a first latent image using a first developer so that a first developer image is developed with the first developer, a second image forming unit that develops a second latent image using a second developer, which is lower in saturation or higher in light-permeability in comparison to the first developer, so that a second developer image is developed with the second developer, a transfer part that transfers the first developer image and the second developer image to a medium, and a control part that controls an amount of the second developer used to develop the second developer image according to a type of the medium.

12 Claims, 11 Drawing Sheets

*Fig. 6*

202A

| Type of Medium P | Glossiness Mode | Fusing Temp. | Density α of Toner 37B |
|---|---|---|---|
| Normal Paper | Low | Low (T1) | 0 |
| | Normal | Midium (T2) | 0 |
| | High | High (T3) | 0 |
| Thick Paper | Low | Low (T1) | 80 |
| | Normal | Midium (T2) | 40 |
| | High | High (T3) | 10 |
| Film | Low | Low (T1) | 60 |
| | Normal | Midium (T2) | 30 |
| | High | High (T3) | 10 |

<< Normal Paper >>

<< Thick Paper >>

<< Film >>

<< Normal Paper >>

<< Thick Paper >>

<< Film >>

*Fig. 10*

202A

| Type of Medium P | Fusing Temp. | Density α of Toner 37B |
|---|---|---|
| Normal Paper | Low (T1) | 0 |
| Thick Paper | Midium (T2) | 40 |
| Film | High (T3) | 30 |

*Fig. 11*

202A

| Glossiness Mode | Fusing Temp. | Density α of Toner 37B |
|---|---|---|
| Low | Low (T1) | 60 |
| Normal | Midium (T2) | 30 |
| High | High (T3) | 10 |

*Fig. 12*

202A

| Fusing Temp. | Density α of Toner 37B |
|---|---|
| Low (T1) | 60 |
| Midium (T2) | 30 |
| High (T3) | 10 |

IMAGE FORMING APPARATUS

CROSS REFERENCE

The present application is related to, claims priority from and incorporates by reference Japanese Patent Application No. 2015-063075, filed on Mar. 25, 2015.

The present invention relates to an image forming apparatus for transferring an image (developer image) to a medium.

In the conventional image forming apparatus such as a printer, a photocopy apparatus, a facsimile apparatus, a multifunction device, etc., after an image (developer image) is transferred onto a medium being carried, the transferred image (developer image) is heated and fused on the medium (for example, see Patent Document 1).

[Patent Document 1] Japanese Unexamined Patent Application Publication No. 2014-106413

In the future, a fusing function capable of accommodating various print conditions will be desired.

The present invention was made in view of the related problems, and aims to provide an image forming apparatus capable of improving the fusing properties under various print conditions.

SUMMARY

An image forming apparatus includes a first image forming unit that develops a first latent image using a first developer so that a first developer image is developed with the first developer, a second image forming unit that develops a second latent image using a second developer, which is lower in saturation or higher in light-permeability in comparison to the first developer, so that a second developer image is developed with the second developer, a transfer part that transfers the first developer image and the second developer image to a medium, and a control part that controls an amount of the second developer used to develop the second developer image according to a type of the medium.

In the present invention, the second developer may be lower in saturation or may be higher in light-permeability than the first developer. For example, ordinary color toners, such as cyan, magenta, yellow or black is available for the first developer. On the other hand, any toner that is used for realizing glossiness on a surface of a printed medium can be used for the second developer. For example, clear toner, white toner or light grey toner is available for the second developer.

According to the image forming apparatus as an embodiment of the present invention, the fusing properties can be improved under various print conditions.

FIG. 6 is a diagram showing one example of a setting table.

FIG. 10 is a diagram showing one modified example of a setting table.

FIG. 11 is a diagram showing one modified example of a setting table.

FIG. 12 is a diagram showing one modified example of a setting table.

Hereinafter, embodiments of the present invention will be explained in detail with reference to the drawings. The following explanation is one specific example of the present invention and the present invention is not limited to the following embodiments. Also, in the present invention, the arrangement, the dimension, and the proportion of each structural component shown in each drawing are not limited to those. Further, the explanation will be done in the following order.

1. Embodiment

An example using an indirect transfer system

2. Modified Examples

Modified Examples 1 to 3: variations of the setting table

Modified Example 4: example in which fusing is separated into two

Modified Example 5: example using a direct transfer system

Modified Example 6: various modified examples

1. EMBODIMENT

[Configuration]

Figure 1:
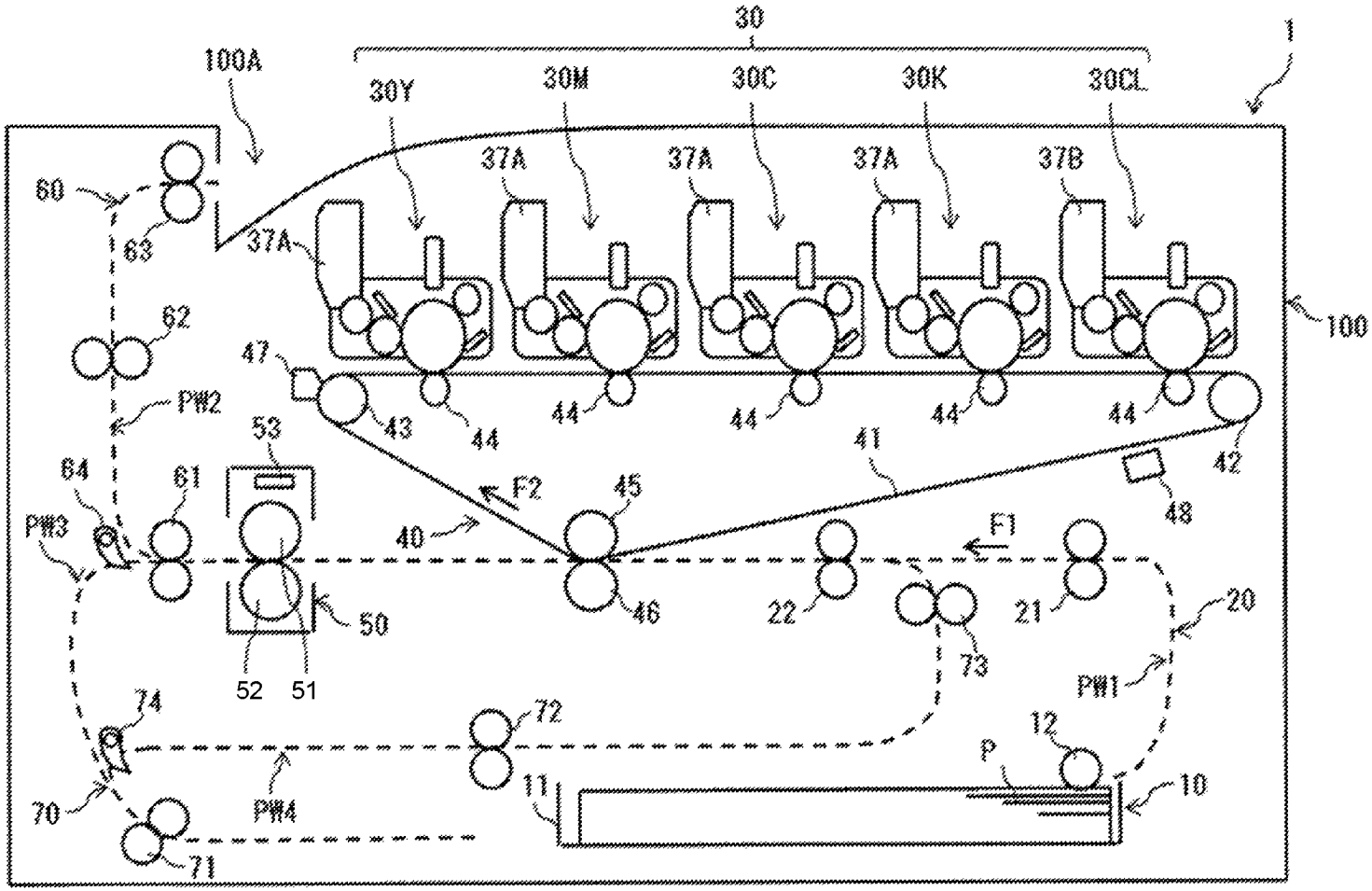
FIG. 1 is a schematic view showing an example of a schematic configuration of an image forming apparatus according to an embodiment of the present invention.

FIG. 1 schematically shows a schematic configuration example of an image forming apparatus 1 according to an embodiment of the present invention. The image forming apparatus 1 is a printer which forms a color image on a medium P such as a paper using an electrographic system. The medium P corresponds to one specific example of a "medium" of the present invention. The image forming apparatus 1 is equipped with a sheet feeding part 10, a carrying part 20, an image forming part 30, a transfer part 40, a fuser part 50, an ejection part 60, and a reverse part 70. The sheet feeding part 10, the carrying part 20, the image forming part 30, the transfer part 40, the fuser part 50, the ejection part 60, and the reverse part 70 are provided inside a housing 100. The transfer part 40 corresponds to one specific example of the "transfer part" of the present invention. The fuser part 50 corresponds to one specific example of the "fuser part" of the present invention.

In this specification, a path along which the medium P is carried is referred to as a carrying path (e.g., the later explained carrying paths PW1 to PW4).

In the carrying path, a direction toward the sheet feeding part 10 or a position closer to the sheet feeding part 10 as viewed from an arbitrary component is referred to as the upstream of the carrying path. In the carrying path, a direction opposite to the direction toward the sheet feeding part 10 or a position farther from the sheet feeding part 10 as viewed from an arbitrary component is referred to as the downstream of the carrying path. In the carrying path, the direction in which the medium P advances (that is, a direction from the upstream of the carrying path toward the downstream of the carrying path) is referred to as a carrying direction F1.

Hereinafter, the carrying path linking the sheet feeding part 10 and the carrying part 20, the carrying path of a medium P in the carrying part 20, the carrying path linking the carrying part 20 and the transfer part 40, the carrying path linking the transfer part 40 and the fuser part 50, and the carrying path linking the fuser part 50 and the ejection part 60 is referred to as a carrying path PW1. The carrying path in the ejection part 60 is referred to as a carrying path PW2. The carrying path linking the ejection part 60 and the reverse part 70 and the predetermined carrying path in the reverse part 70 are referred to as a carrying path PW3. The carrying path linking to the carrying path PW3 in the reverse part 70 is referred to as a carrying path PW4. The carrying path PW4 is also linked to the carrying path PW1.

(Configuration of the Sheet Feeding Part 10)

The sheet feeding part 10 is for supplying the medium P one by one to the carrying path PW1. The sheet feeding part 10 is provided with, for example, a sheet feeding tray 11 and a pickup roller 12. A plurality of mediums P is accommodated in the sheet feeding tray 11 in a stacked state. The sheet feeding tray 11 is removably attached, for example, to the lower part of the image forming apparatus 1. The pickup roller 12 supplies the medium P accommodated in the sheet feeding tray 11 to the carrying part 20. The pickup roller pair 12 rotates in the direction in which the medium P is fed to the carrying path PW1 by being controlled by the later explained process control part 300.

(Configuration of the Carrying Part 20)

The carrying part 20 carries the medium P to the transfer part 40 along the carrying path PW1 and regulates the skew. The carrying part 20 is arranged downstream of the carrying path PW1 than the sheet feeding part 10. The carrying part 20 is provided with, for example, a carrying roller pair 21, a carrying roller pair 21, and a registration roller pair 22. The carrying roller pair 21 and the registration roller pair 22 are arranged in the order of the carrying roller pair 21 and the registration roller pair 22 toward the carrying direction F1.

The carrying roller pair 21 carries the medium P in the carrying direction F1 along the carrying path PW1. The carrying roller pair 21 rotates in the direction in which the medium P is carried in the carrying direction F1 by being controlled by the later explained process control part 300. The registration roller pair 22 regulates the skew of the medium P. The registration roller pair 22 rotates in the direction in which the medium P is carried in the carrying direction F1 by being controlled by the later explained process control part 300 and regulates the skew of the medium P.

(Configuration of Image Forming Part 30)

The image forming part 30 forms an image (toner image) on the circumferential surface 31A of a later explained photosensitive drum 31. The image forming part 30 is provided with, for example, five image forming units. The five image forming units are constituted by, for example, as shown in FIG. 1, image forming units 30Y, 30M, 30C, 30K, and 30CL. The image forming units 30Y, 30M, 30C, and 30K correspond to one specific example of the "first image forming unit" of the present invention. The image forming unit 30CL corresponds to one specific example of the "second image forming unit" of the present invention.

Figure 2:
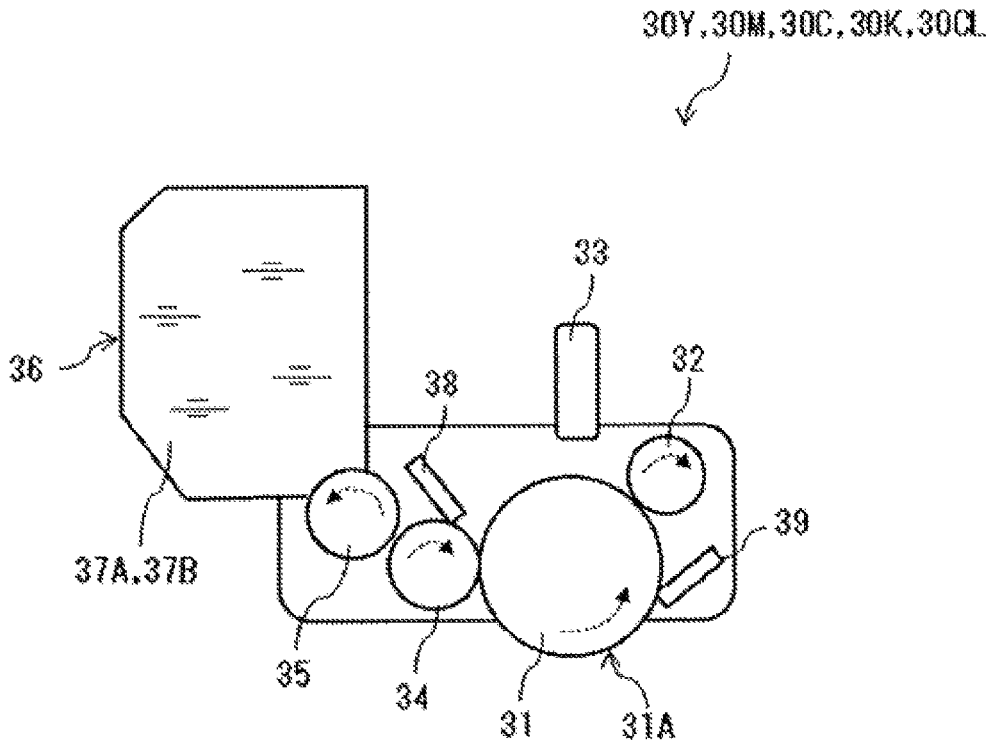
FIG. 2 is a schematic view showing an example of a schematic configuration of an image forming unit of FIG. 1.

FIG. 2 schematically shows an example of a schematic configuration of the image forming units 30Y, 30M, 30C, 30K, and 30CL. The image forming units 30Y, 30M, 30C, and 30K each develops an electrostatic latent image Ia on the circumferential face 31A of the photosensitive drum 31 using each of corresponding toners 37A, that is, yellow toner, magenta toner, cyan toner, and black toner and forms toner an image Ib of each color. The toner 37A corresponds to one specific example of the "first developer" of the present invention. The electrostatic latent image Ia corresponds to one specific example of the "first latent image" of the present invention. The toner image Ib corresponds to one specific example of the "first developer image" of the present invention.

The image forming unit 30CL forms a toner image Id by developing an electrostatic latent image Ic on the circumferential face 31A of the photosensitive drum 31 using a toner 37B which is lower in saturation or higher in light-permeability compared to the toner 37A, such as a clear toner. The toner 37B corresponds to one specific example of the "second developer" of the present invention. The electrostatic latent image Ic corresponds to one specific example of the "second latent image" of the present invention. The toner image Id corresponds to one specific example of the "second developer image" of the present invention.

For the clear toner of the invention, any type of specific toners may be available as long as the permeability or transparency of the toners satisfy a following condition even when the transparency is not 100%. Where one colored layer made of a color toner and one specific layer made of the specific toner are accumulated by the colored layer being disposed under the specific layer, and the colored layer can be seen through the specific layer from the top, the specific toner may be classified in the clear toner of the invention. Further, for a toner with lower saturation, it may includes not only the clear toner discussed above but a white toner, and a light grey toner etc. also.

The image forming units 30Y, 30M, 30C, 30K, and 30CL are arranged in the order of, for example, the image forming unit 30Y, the image forming unit 30M, the image forming unit 30C, the image forming unit 30K, and the image forming unit 30CL toward the rotational direction F2 of the later explained transfer belt 41. The image forming units 30Y, 30M, 30C, 30K, and 30CL are constituted by common elements.

The image forming unit 30Y, 30M, 30C, 30K, and 30CL are each equipped with, for example, a photosensitive drum 31, a charge roller 32, an LED (Light Emitting Diode) head 33, a development roller 34, a supply roller 35, a cartridge 36, a regulation blade 38, and a cleaning blade 39. In the image forming units 30Y, 30M, 30C, and 30K, the cartridge 36 is filled with a toner 37A. In the image forming unit 30CL, the cartridge 36 is filled with a toner 37B.

The photosensitive drum 31 is provided with a circumferential surface 31A including a photosensitive body (e.g., organic photosensitive body), and is a column-shaped member capable of supporting electrostatic latent images Ia and Ic on the circumferential surface 31A. Specifically, the photosensitive drum 31 is provided with a conductive supporting body and a photoconductive layer covering its outer circumference (surface). The conductive supporting body is constituted by, e.g., an aluminum metal pipe. The photoconductive layer has a structure in which, for example, a charge generation layer and a charge transportation layer are laminated in that order. The photosensitive drum 31 rotates in the direction in which the transfer belt 41 rotates in the rotational direction F2 at a predetermined peripheral speed by being controlled by the process control part 300.

The charge roller 32 is a member (charger member) for charging the circumferential surface 31A of the photosensitive drum 31. The charge roller 32 is arranged so as to come in contact with the circumferential surface 31A of the photosensitive drum 31 and arranged facing the circumferential surface 31A. The charge roller 32 is provided with, for example, a metal shaft made of stainless steel and a semiconductive elastic layer (e.g., a semiconductive epichlorohydrin layer) covering its outer circumference (surface). The charge roller 32 is configured to rotate in a direction opposite to a rotational direction of the photosensitive drum 31 by, for example, the drive transmission of the photosensitive drum 31. A charged voltage is applied to the charging member of the charge roller 32 from the process control part 300.

The LED head 33 exposes the charged region of the circumferential face 31A charged by the charge roller 32 by being controlled by the process control part 300 to form the electrostatic latent images Ia and Ic on the charged region of the circumferential face 31A. The LED head 33 is arranged so as to face the circumferential face 31A at a downstream position in the rotating direction of the photosensitive drum 31 than the charge roller 32. The LED head 33 includes a plurality of LED light emitting parts arranged in the widthwise direction of the photosensitive drum 31. Each LED light emitting part is constituted so as to include, for example, a light source such as a light emitting diode emitting irradiation light and a lens array for forming an image on the surface of the photosensitive drum 31 using the irradiation light.

The development roller 34 is a member for carrying the toners 37A and 37B to the surface and develops electrostatic latent images Ia and Ic using the toners 37A and 37B. The development roller 34 is arranged so as to come into contact with the circumferential surface 31A of the photosensitive drum 31 and arranged facing the circumferential surface 31A at a downstream position in the rotational direction of the photosensitive drum 31 than the LED head 33. The development roller 34 is provided with, for example, a metal shaft made of stainless steel and a semiconductive elastic layer (e.g., a semiconductive urethane rubber layer) covering its outer circumference (surface). The development roller 34 is configured to rotate in a direction opposite to a rotating direction of the photosensitive drum 31 by, for example, the drive transmission of the photosensitive drum 31. A development voltage is applied to the surface of the development roller 34 from the process control part 300.

The supply roller 35 is a member (supply member) for supplying the toner 37A and 37B to the development roller 34, and is arranged so as to come into contact with the surface (circumferential surface) of the development roller 34. The supply roller 35 is provided with, for example, a metal shaft made of stainless steel and a forming elastic layer (e.g., a silicone rubber layer) covering its outer circumference (surface). The supply roller 35 is configured to rotate in a direction opposite to the rotational direction of the development roller 34 by, for example, the drive transmission of the development roller 34. A supply voltage is applied to the surface of the supply roller 35 from the process control part 300.

The cartridge 36 is a container in which the aforementioned toner 37A and 37B is accommodated. In the image forming unit 30Y, a yellow toner 37A is accommodated in the cartridge 36. In the image forming unit 30M, a magenta toner 37A is accommodated in the cartridge 36. In the image forming unit 30C, a cyan toner 37A is accommodated in the cartridge 36. In the image forming unit 30K, a black toner 37A is accommodated in the cartridge 36. In the image forming unit 30CL, a toner 37B that is low in saturation or high in light-permeable in comparison to the toner 37A is accommodated in the cartridge 36.

The regulating blade 38 is for regulating the thickness of a layer of the toner 37A and 37B carried on the surface of the development roller 34. The regulating blade 38 is made of, for example, a thin plate of SUS (Steel Use Stainless). The cleaning blade 39 is for scraping off the toner 37A and 37B that remains on the surface of the photosensitive drum 31. The cleaning blade 39 is made of, for example, a flexible rubber material or a plastic material.

Figure 3:
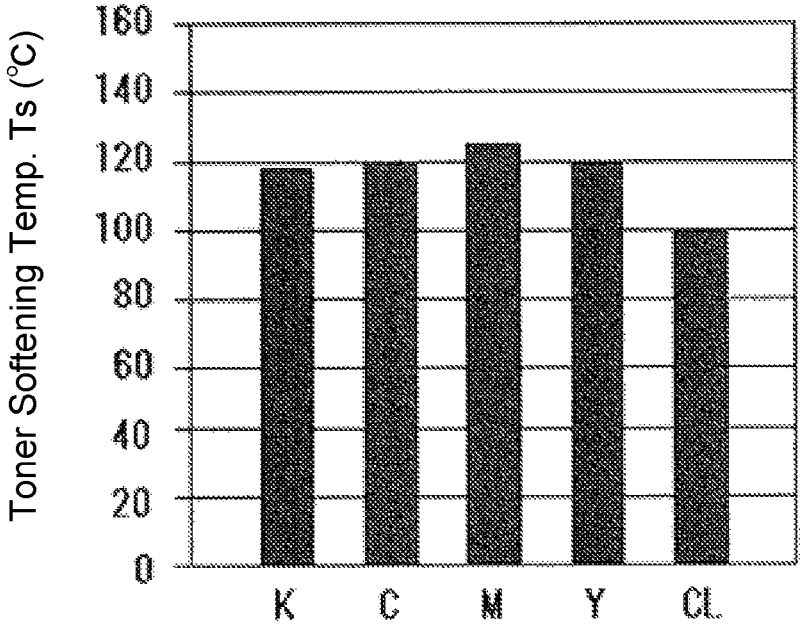
FIG. 3 is a view showing one example of a toner softening temperature.

FIG. 3 is shows one example of the softening temperatures Ts of the toners 37A and 37B filled in each of the cartridges 36. The softening temperature Ts refers to a temperature of the softening point of the material. In FIG. 3, "K" refers to the black toner 37A.

"C" refers to the cyan toner 37A.

"M" refers to the magenta toner 37A.

"Y" refers to the yellow toner 37A.

"CL" refers to the toner 37B.

The softening temperature Ts of the toner 37B, as shown in FIG. 3, is lower than any of the softening temperatures Ts of the toners 37A. That is, the toner 37B is constituted by a material having a fusing temperature lower than the fusing temperatures of any of the toners 37A.

The flowing start temperature Tf and the melting temperature Tm of the toner 37B can be lower than the flowing start temperatures Tf and the melting temperatures Tm of any of the toners 37A. That is, the toner 37B can be constituted by a material having a flowing start temperature Tf and a melting temperature Tm lower than the flowing temperatures Tf and the melting temperatures Tm of any of the toners 37A.

The thermal properties of each of the toners 37A and 37B, i.e., the softening temperature Ts, the flowing start temperatures Tf, and the melting temperatures Tm, are measured by a flowing property evaluation device (made by Shimadzu Corporation, CFT-500D, toner amount: 1.0 [g], die diameter: 1.0 [mm], die length: 1.0 [mm], load: 10 [kg], start temperature: 50 [° C.], pre-heating time: 300 [sec], temperature elevation rate: 3 [° C./min], temperature elevation method). In a temperature elevation method flow curve obtained by the measurement, the softening temperatures Ts of the toners 37A and 37 B are temperatures at which the internal voids vanish and becomes one phase, the flowing start temperatures Tf of the toners 37A and 37B are temperatures at which the toners change into a flowing state, and the melting temperatures Tm are temperatures calculated by a ½ method.

(Configuration of Transfer Part 40)

The transfer part 40 electrostatically transfers the toner images Ib and Id on the medium P carried from the carrying part 20. The transfer part 40 transfers one or a plurality of toner images Ib on the medium P, and after transferring the toner images Id to the toner image Ib, it carries the medium P in which the toner images Ib and Id are laminated to the fuser part 50. The toner image Ib is formed by developing an electrostatic latent image of the circumferential face 31A by any one of the image forming units 30Y, 30M, 30C, and 30K. The toner image Id is formed by developing an electrostatic latent image of the circumferential face 31A by any one of the image forming units 30CL. The transfer part 40 includes, for example, a transfer belt 41, a drive roller 42 driving the transfer belt 41, a tension roller 43 which is a driven roller, a plurality of primary transfer rollers 44, an opposing roller 45, a secondary transfer roller 46, a cleaning member 47, and a concentration sensor 48. The transfer part 40 is a mechanism in which, after the toner images Ib and Id formed in each of the image forming units 30Y, 30M, 30C, 30K and 30CL are sequentially transferred to the surface of the transfer belt 41, the toner images Ib and Id on the transfer belt 41 are transferred to the medium P carried from the sheet feeding and carrying part 20.

Figure 4A:
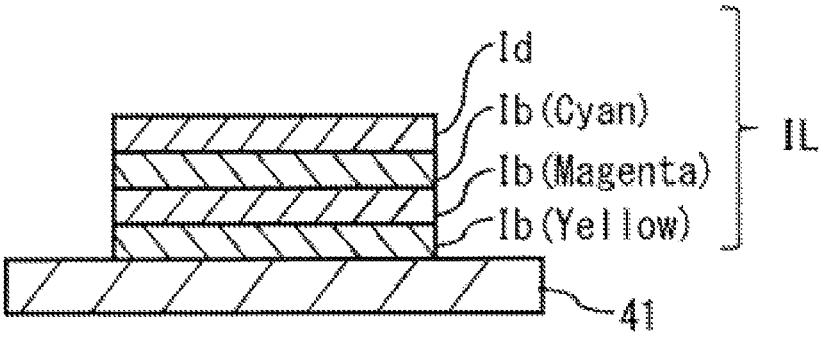
FIG. 4A is a cross-sectional view showing one example of a laminated toner image on a transfer belt.
Figure 4B:
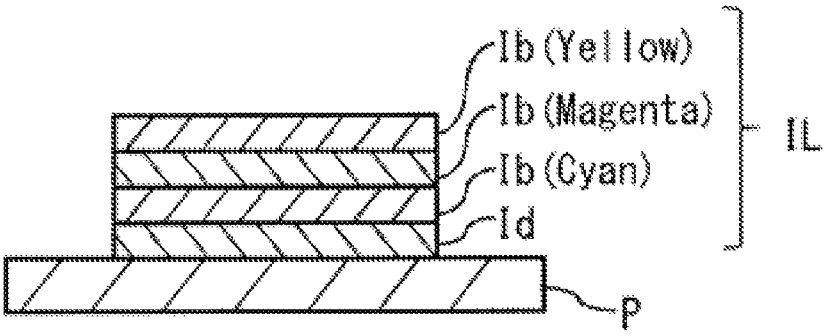
FIG. 4B is a cross-sectional view showing one example of a laminated toner image on a medium.

FIG. 4A shows one example of a cross-sectional configuration of a laminated toner image IL formed by sequentially transferring one of a plurality of toner images Ib and a toner image Id on the surface of the transfer belt 41. In FIG. 4A, as a laminated toner image IL, an example in which the yellow toner image Ib, the magenta toner image Ib, the cyan toner image Ib, and the toner image Id are sequentially laminated on the surface of the transfer belt 41 is exemplified. FIG. 4B shows one example of the cross-sectional configuration of a laminated toner image IL on the medium P when the laminated toner image IL on the transfer belt 41 is transferred to the surface of the medium P. On the transfer belt 41, the toner image Id is arranged at the uppermost layer of the laminated toner image IL and is not in contact with the medium P. On the other hand, on the medium P, the toner image Id is arranged at the lowermost layer of the laminated toner image IL and is in contact with the medium P. That is, on the medium P, the toner image Id is arranged between the lamination of one toner image Ib or one or a plurality of toner images Ib and the medium P. The toner image Id plays a role of an adhesive under layer on the toner image Ib in the laminated toner image IL on the medium P.

The transfer belt 41 is, for example, an endless elastic belt made of a resin material such as polyimide resin. The transfer belt 41 is tensioned (stretched) by the drive roller 42, the tension roller 43, and the opposing roller 45, and is supported in a rotatable manner. The drive roller 42 rotates the transfer belt 41 circularly in the rotational direction F2 while being controlled by the process control part 300. The tension roller 43 is configured to adjust the tension applied to the transfer belt 41 by the bias force by a bias member. The tension roller 43 rotates in the same direction as the development roller 42.

A plurality of primary transfer rollers 44 are assigned one by one to each of the image forming units 30Y, 30M, 30C, 30K, and 30CL. Each of the primary transfer rollers 44 electrostatically transfers the image formed on the circumferential surface 31A of the photosensitive drum 31 to the transfer belt 41. Each of the primary transfer rollers 44 is arranged so as to be in contact with the inner circumferential surface of the transfer belt 41 and facing the photosensitive drum 31. Each of the primary transfer rollers 44 is a member in which, for example, a metal shaft is covered with a conductive elastic body. A primary transfer voltage is applied to the surface of each of the primary transfer rollers 44 from the process control part 300.

The opposing roller 45 and the secondary transfer roller 46 are arranged so as to face each other and sandwich the transfer belt 41. The secondary transfer roller 46 electrostatically transfers the toner images Ib and Id on the transfer belt 41 to the medium P carried along the carrying path PW1. The secondary transfer roller 46 includes, for example, a metallic core material and an elastic layer such as a foamed rubber layer formed so as to be wound on the outer circumferential surface of the core material. The opposing roller 45 is rotated in the direction in which the transfer belt 41 moves in the rotational direction F2 by being controlled by the process control part 300. A secondary transfer voltage is applied to the surface of each of the secondary transfer rollers 46 from the process control part 300.

The cleaning member 47 is arranged, for example, downstream of the secondary transfer roller 46 and upstream of the most upstream image forming unit (image forming unit 30Y) in the rotational direction F2 of the transfer belt 41. The cleaning member 47 is for scraping off the toners 37A and 37B remaining on the surface of the transfer belt 41. The cleaning member 47 is made of, for example, a flexible rubber material or a plastic material.

The concentration sensor 48 is for detecting the density of the toner images Ib and Id not for printing on the transfer belt 41. "Not for printing" means that the toner images Ib and Id are not printed on the medium P. The concentration sensor 48 detects the density of the toner images Ib and Id not for printing on the transfer belt 41 before the start of printing by being controlled by the controller 200. "The start of printing" refers to the time at which the printing of the toner images Ib and Id for printing, formed by being developed by a development roller 34, onto the medium P starts. "For printing" means that the toner images Ib and Id are printed on the medium P.

The concentration sensor 48 is equipped with, for example, a light emitting diode (LED) which irradiates the toner images Ib and Id not for printing on the transfer belt 41, and a light receiving diode for receiving, among lights emitted from the light emitting diode, the light reflected (reflected light) by the toner images Ib and Id not for printing on the transfer belt 41. The detection signal output from the light receiving diode relates to the strength of the reflection light having a correlation with the density of the toner images Ib and Id not for printing. The concentration sensor 48 drives the light emitting diode and the light receiving diode based on, for example, the control signal input from the controller 200. The concentration sensor 48, for example, processes the detection signals output from the light receiving diode and outputs the density data Dd of the toner images Ib and Id not for printing. The concentration sensor 48 is arranged at a position facing the transfer belt 41. The concentration sensor 48, for example, is arranged downstream of the secondary transfer roller 44 and upstream of the secondary transfer roller 46 in the rotational direction F2 of the transfer belt 41.

(Configuration of Fuser Part 50)

The fuser part 50 is a member for fusing the toner images Ib and Id on the medium P at a predetermined temperature. The fuser part 50 is configured to fuse the toner images Ib and Id transferred on the medium P which has passed through the transfer part 40 by applying heat and pressure to the toner images Ib and Id on the medium P. The fuser part 50 is arranged downstream of the carrying path PW1 than the transfer part 40. The fuser part 50 is constituted so as to include, for example, an upper roller 52, a lower roller 51, and a temperature sensor 53.

The upper roller 51 is constituted so as to include a heat source which is a heating heater such as a halogen lamp, etc., inside the upper roller 51 and functions as a heating roller for applying heat on the toner images Ib and Id on the medium P. The upper roller 51 rotates in the direction in which the medium P is carried in the carrying direction F1 by being controlled by a later explained controller 200. The heat source of the upper roller 51 controls the surface temperature of the upper roller 51 by being controlled by the process control part 300. The lower roller 52 is arranged so as to face the upper roller 51 in a manner such that a press-contacted part is formed between the lower roller 52 and the upper roller 51, and functions as a pressure application roller for applying a pressure on the toner images Ib and Id on the medium P. The lower roller 52 is preferably provided with a surface layer made of an elastic material. The temperature sensor 53 is configured to detect the surface temperature of the upper roller 51 and output data of the detected surface temperature (temperature data Dt). The bias voltage to be applied to the heat source in the upper roller 51 is set based on the output signal of the temperature sensor 53.

(Configuration of Ejection Part 60)

The ejection part 60 ejects the medium P on which the toner images Ib and Id are fused by the fuser part 50 to the outside. The ejection part 60 is provided with, for example, carrying roller pairs 61, 62, and 63, and a switching guide 64. The carrying roller pairs 61, 62, and 63 eject the medium P outside via the carrying path PW2, and for example, stock them on an external stacker 100A. The carrying roller pair 61 rotates in the direction in which the medium P is carried in the carrying direction F1 by being controlled by a later explained controller 200. Further, the carrying roller pairs 61, 62, and 63 eject, for example, the medium P facing down.

(Configuration of Reverse Part 70)

The reverse part 70 feeds the medium P carried to the carrying path PW3 by the switching guide 64 to the upstream side of the secondary transfer roller 46 in the carrying path PW1 by reversing the front and back. The medium P fed from the carrying path PW1 via the reverse part 70 passes through the carrying part 20 and transfer part 40 in a state in which the front and the back are reversed from when it was fed from the sheet feeding part 10. That is, the image forming apparatus 1 is configured to be printable on both sides by the function of the reverse part 70.

The reverse part 70 is provided with, for example, a reverse roller pair 71, carrying roller pairs 71, 72, and 73, and a switching guide 74. The reverse roller pair 71 once pulls in the medium P to the part on the carrying path PW3 used for reversing, then feeds it to the carrying path PW4 via the switching guide 74. The reverse roller pair 71 is arranged downstream of the switching guide 74 on the carrying path PW3. The carrying roller pairs 72 and 73 feed the medium P fed to the carrying path PW4 via the switching guide 74 to the carrying path PW1. The carrying roller pairs 72 and 73 are arranged on the carrying path PW4. The switching guide 74 moves to a position that does not block the carrying path PW3 when pulling in the medium P to the reverse roller pair 71 side by being controlled by the controller 200. Further, the switching guide 74, when pulling in the medium P to the carrying path PW4, moves to a position in which the carrying path PW3 is blocked and the medium P fed from the reverse roller pair 71 side enters the carrying path PW4.

(Control Mechanism)

Figure 5:
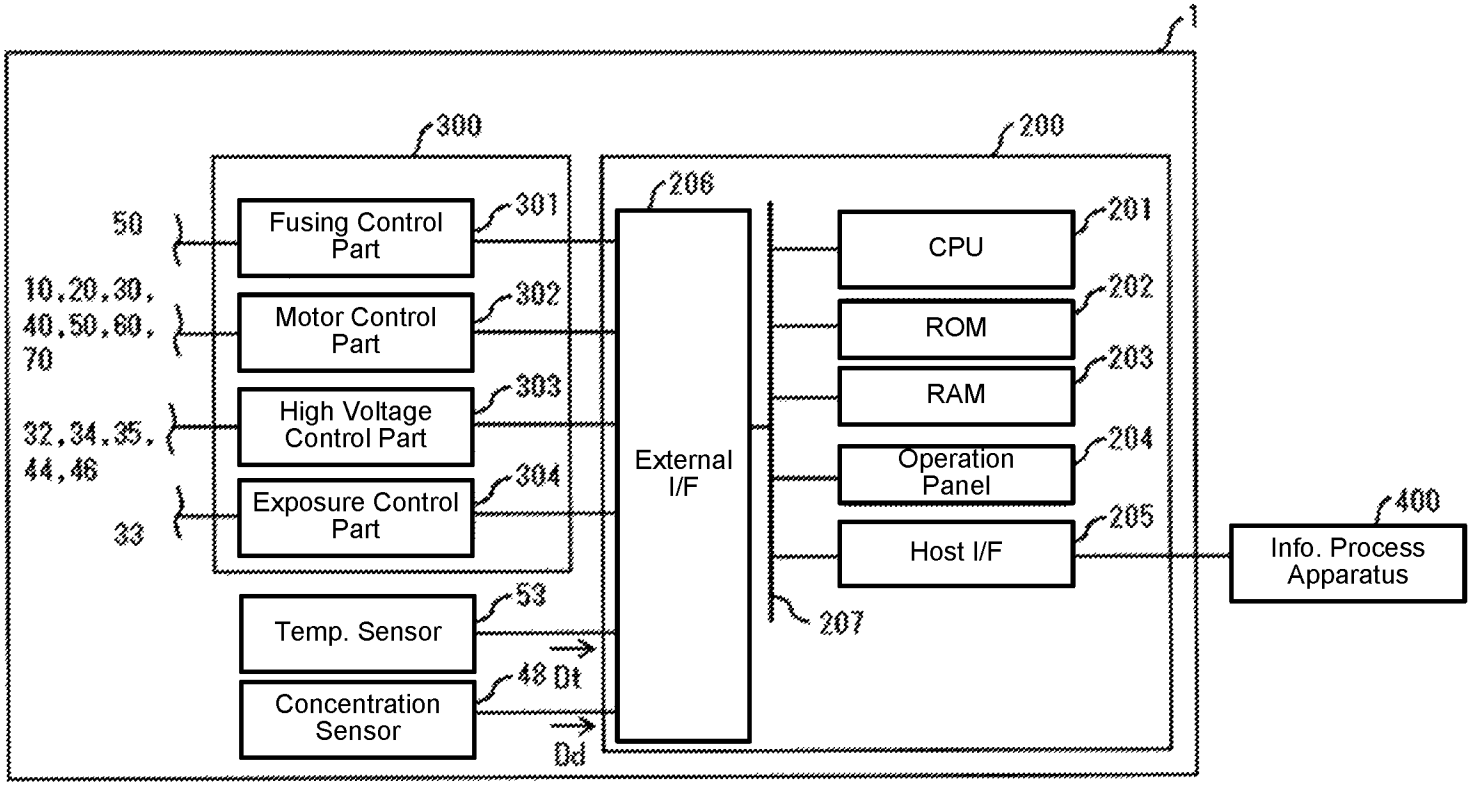
FIG. 5 is a schematic view showing one example of a control mechanism of the image forming apparatus of FIG. 1.

Next, the control mechanism of the image forming apparatus 1 will be explained with reference to FIG. 5 in addition to FIG. 1. FIG. 5 shows one example of the control mechanism of the image forming apparatus 1 in a block diagram.

As shown in FIG. 1 and FIG. 5, the image forming apparatus 1 includes, for example, a controller 200 and a process control part 300 as control mechanisms. The controller 200 controls the sheet feeding part 10, the carrying part 20, the image forming part 30, the transfer part 40, the fuser part 50, the ejection part 60, and the reverse part 70 via the process control part 300 based on the print data input by the information process apparatus 400. The process control part 300 controls the sheet feeding part 10, the carrying part 20, the image forming part 30, the transfer part 40, the fuser part 50, the ejection part 60, and the reverse part 70 based on the control signal input by the controller 200.

The controller 200, for example, includes a CPU 201, a ROM 202, a RAM 203, an operation panel 204, a host I/F205, and an external I/F206. The ROM 202 is a memory part for storing a control program for operating the image forming apparatus 1, initial setting information, and a setting table 202A. RAM 203 is a memory part for storing a work needed to operate the image forming apparatus 1. The operation panel 204, for example, displays the state of the image forming apparatus 1, and displays information for prompting an action of a user. The operation panel 204, for example, when a user's finger, etc., comes in to contact with the display face, forwards the information corresponding to the contact position to the CPU 201. The host I/F205 receives the print data sent from the external information process apparatus 400 connected to the image forming apparatus 1 and forwards it to the CPU 201. The external I/F206 transfers the control signal sent from the CPU 201 to the process control part 300, and forwards the data sent from the process control part 300 (for example, temperature data Dt or density data Dd) to the CPU 201. The CPU 201 controls, for example, various components to be controlled in the image forming apparatus 1 via an internal bus 207. The CPU 201 controls the printing operation of the image forming apparatus 1 based on, for example, the control program, the initial setting information, and the setting table 202A fetched from the ROM 202, the information input in the operation panel 204, and the print data input from the outside.

Next, a setting table 202A will be explained. FIG. 6 shows one example of the setting table 202A. The setting table 202A changes the initial setting information fetched from the ROM 202 based on the information input into the operation panel 204. The initial setting information includes the type of the medium P and the types of the glossiness mode. The type of the medium P included in the initial setting information is, for example, a normal paper. The type of the glossiness mode included in the initial setting information is, for example, normal glossiness. The glossiness mode is a mode relating to the fusing temperature Tt set in the fuser part 50. The glossiness mode is for selecting the glossiness of the toner image Ib.

In the setting table 202A, the fusing temperature and the density $\alpha$ (0% or more and 100% or less) of the toner 37B are set according to the type of the medium P and the type of the glossiness mode. The density $\alpha$ of the toner 37B is a parameter having a correlation with the print area ratio and the thickness of the toner 37B per print pixel. The density $\alpha$=0% of the toner 37B means that the toner 37B is not printed. The density $\alpha$=100% of the toner 37B means that the toner 37B is printed on the entire print pixel or that the toner 37B is the targeted thickness. The density $\alpha(0\%<\alpha<100\%)$ of the toner 37B means that the toner 37B is printed such that the print area of the toner 37B is $\alpha$ % of the entire print pixel, and that the toner 37B is printed such that the thickness of the toner 37B is $\alpha$ % of the targeted thickness.

In the setting table 202A, a normal paper, a thick paper, and a film are prescribed as the type of the medium P. In the setting table 202A, low gloss, normal gloss, and high gloss are prescribed as the glossiness mode. In the setting table 202A, the fusing temperature Tt is set to a low temperature (for example, temperature T1) when the glossiness mode is low gloss, set to a medium temperature (for example, temperature T2) when the glossiness mode is normal gloss, and set to a high temperature (for example, temperature T3) when the glossiness mode is high gloss.

Figure 7A:
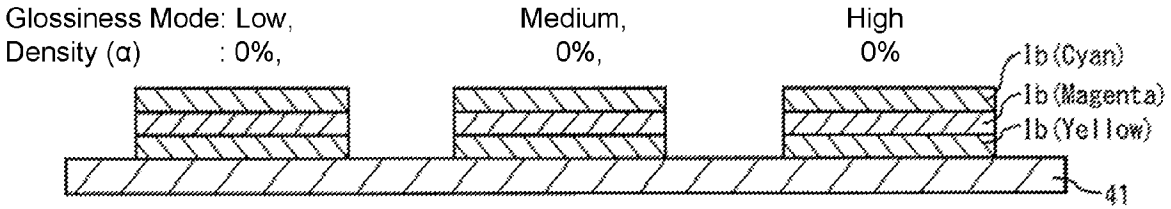
FIG. 7A is a cross-sectional view showing one example of a laminated toner image on a transfer belt when a normal paper is selected as the medium P.
Figure 7B:
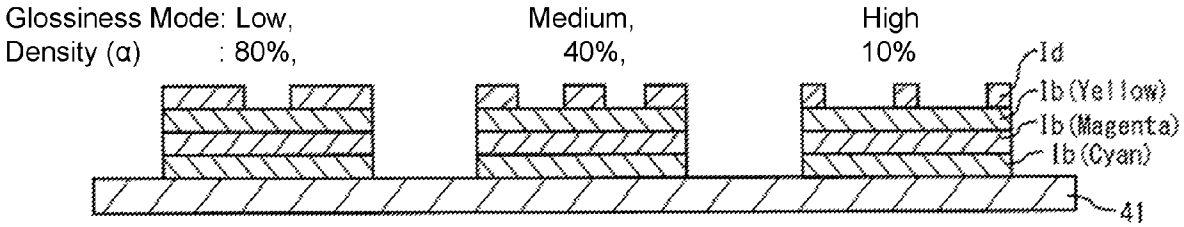
FIG. 7B is a cross-sectional view showing one example of a laminated toner image on a transfer belt when a thick paper is selected as the medium P.
Figure 7C:
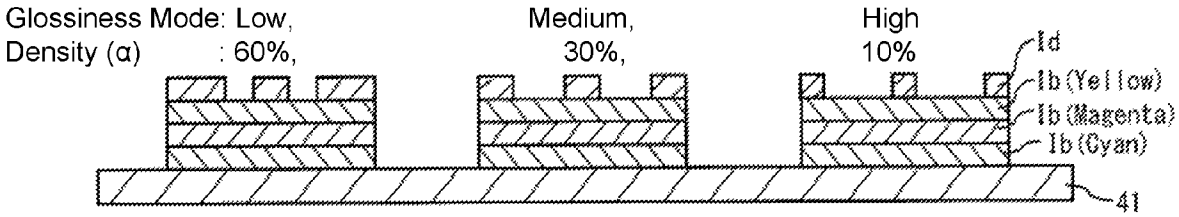
FIG. 7C is a cross-sectional view showing one example of a laminated toner image on a transfer belt when a film is selected as the medium P.
Figure 8A:
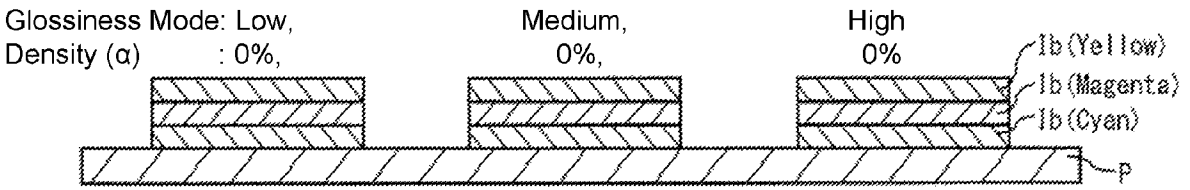
FIG. 8A is a cross-sectional view showing one example of a laminated toner image on a medium when a normal paper is selected as the medium P.
Figure 8B:
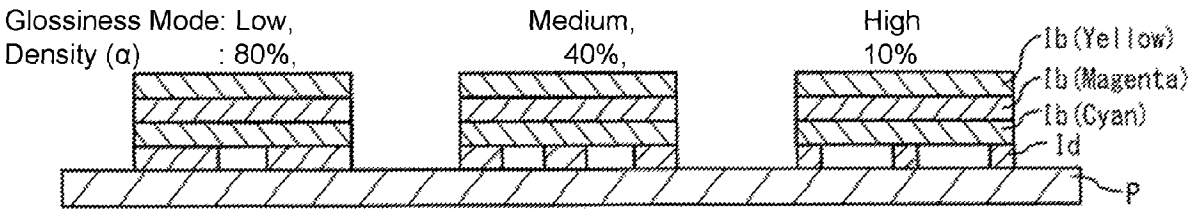
FIG. 8B is a cross-sectional view showing one example of a laminated toner image on a medium when a thick paper is selected as the medium P.
Figure 8C:
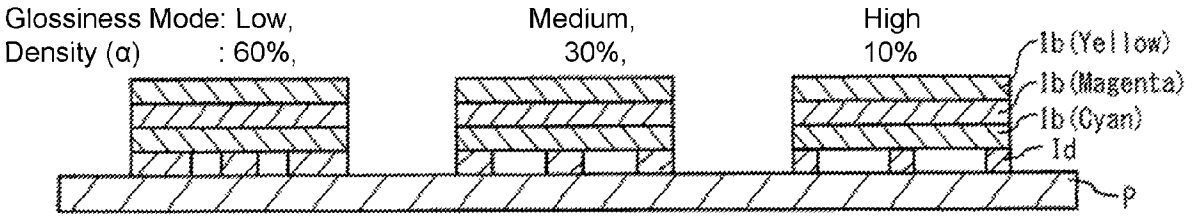
FIG. 8C is a cross-sectional view showing one example of a laminated toner image on a medium when a film is selected as the medium P.
Figure 9:
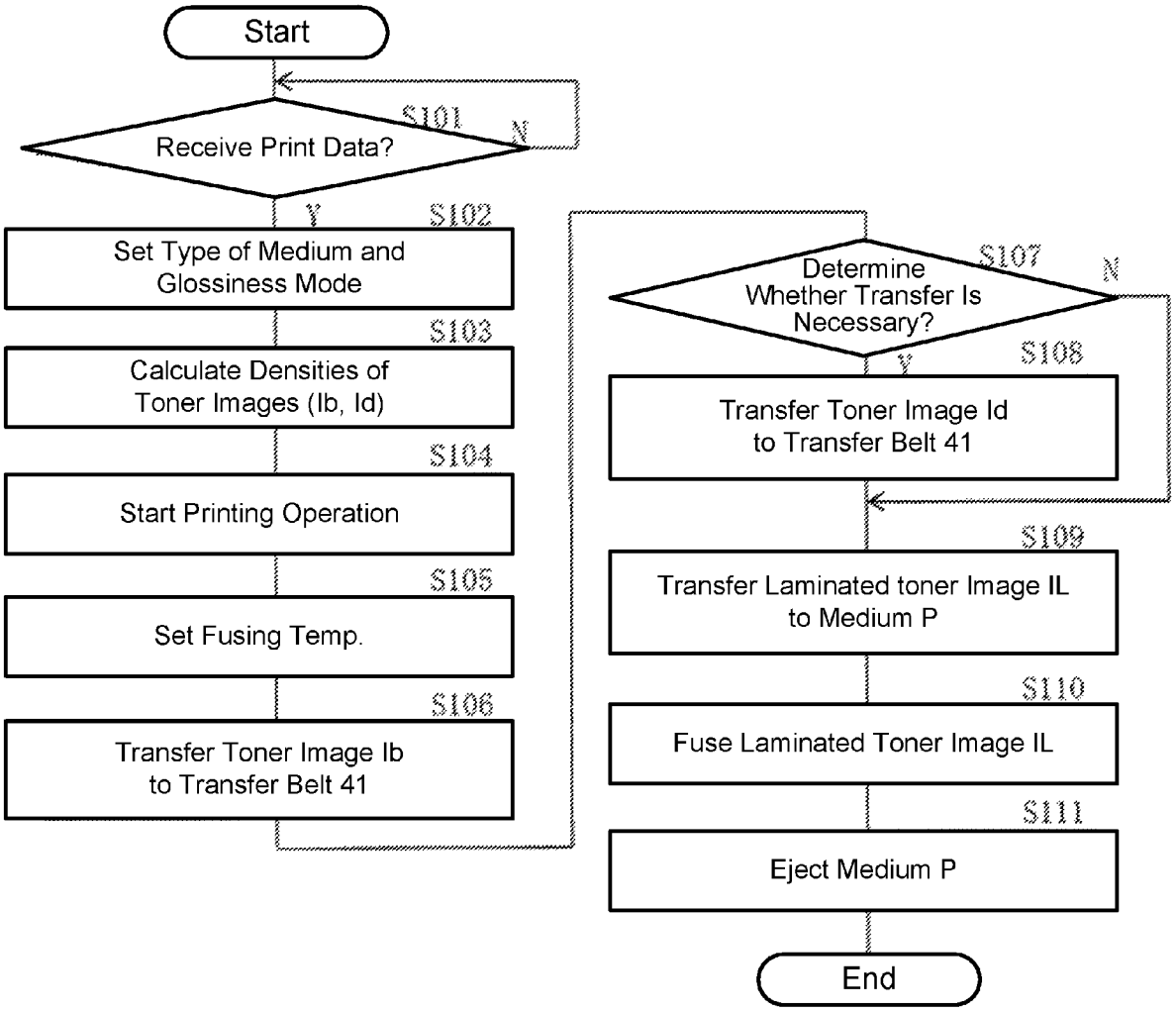
FIG. 9 is a flow diagram showing one example of the print operation procedure of the image forming apparatus of FIG. 1.

FIG. 7A shows an example of the cross-sectional configuration of a laminated toner image IL on the transfer belt 41 when a normal paper is selected as the medium P. FIG. 7B shows an example of the cross-sectional configuration of a laminated toner image IL on a transfer belt 41 when a thick paper is selected as the medium P. FIG. 7C shows an example of the cross-sectional configuration of a laminated toner image IL on a transfer belt 41 when a film is selected as the medium P. FIG. 8A shows an example of the cross-sectional configuration of a laminated toner image IL on a medium P when a normal paper is selected as the medium P. FIG. 8B shows an example of the cross-sectional configuration of a laminated toner image IL on a medium P when a thick paper is selected as the medium P. FIG. 8C shows an example of the cross-sectional configuration of a laminated toner image IL on a medium P when a film is selected as the medium P. In addition, in FIG. 7A, FIG. 7B, FIG. 7C, FIG. 8A, FIG. 8B, and FIG. 8C, the manner in which the density $\alpha$ of the toner image Id (toner 37B) is changing according to the change in the print area ratio of the toner 37B per print pixel is exemplified.

In the setting table 202A, the density $\alpha$ of the toner 37B on a normal paper is set to a constant value regardless of the glossiness mode, and for example, set to 0%. At this time, for example, as shown in FIG. 7A, the toner image Id (toner 37B) is not formed in the uppermost layer of the laminated toner image IL on the transfer belt 41 regardless of the glossiness mode. Further, for example, as shown in FIG. 8A, the toner image Id (toner 37B) is not formed in the lowermost layer of the laminated toner image IL on the medium P regardless of the glossiness mode.

In the setting table 202A, the density $\alpha$ of the toner 37B on the thick paper is set to a high density (e.g., 80%) when the glossiness mode is low gloss. At this time, for example, as shown on the left in FIG. 7B, the toner image Id (toner 37B) at 80% density is formed at the uppermost layer of the laminated toner image IL on the transfer belt 41. Further, for example, as shown on the left in FIG. 8B, the toner image Id (toner 37B) at 80% density is formed at the lowermost layer of the laminated toner image IL on the medium P. In the setting table 202A, the density $\alpha$ of the toner 37B on the thick paper is set to a medium density (e.g., 40%) when the glossiness mode is medium gloss. At this time, for example, as shown at the center of FIG. 7B, the toner image Id (toner 37B) at 40% density is formed at the uppermost layer of the laminated toner image IL on the transfer belt 41. Further, for example, as shown at the center of FIG. 8B, the toner image Id (toner 37B) at 40% density is formed at the lowermost layer of the laminated toner image IL on the medium P. In the setting table 202A, the density $\alpha$ of the toner 37B on the thick paper is set to a low density (e.g., 10%) when the glossiness mode is high gloss. At this time, for example, as shown on the right in FIG. 7B, the toner image Id (toner 37B) at 10% density is formed at the uppermost layer of the laminated toner image IL on the transfer belt 41. At this time, for example, as shown on the right in FIG. 8B, the toner image Id (toner 37B) at 10% density is formed at the lowermost layer of the laminated toner image IL on the medium P.

In the setting table 202A, the density $\alpha$ of the toner 37B on the film is set to a high density (e.g., 60%) when the glossiness mode is low gloss. At this time, for example, as shown on the left in FIG. 7C, the toner image Id (toner 37B) at 60% density is formed at the uppermost layer of the laminated toner image IL on the transfer belt 41. Further, for example, as shown on the left in FIG. 8C, the toner image Id (toner 37B) at 60% density is formed at the lowermost layer of the laminated toner image IL on the medium P. In the setting table 202A, the density $\alpha$ of the toner 37B on the film is set to a medium density (e.g., 30%) when the glossiness mode is medium gloss. At this time, for example, as shown at the center of FIG. 7C, the toner image Id (toner 37B) at 30% density is formed at the uppermost layer of the laminated toner image IL on the transfer belt 41. Further, for example, as shown at the center of FIG. 8C, the toner image Id (toner 37B) at 30% density is formed at the lowermost layer of the laminated toner image IL on the medium P. In the setting table 202A, the density $\alpha$ of the toner 37B on the film is set to a low density (e.g., 10%) when the glossiness mode is high gloss. At this time, for example, as shown on the right in FIG. 7C, the toner image Id (toner 37B) at 10% density is formed at the uppermost layer of the laminated toner image IL on the transfer belt 41. Further, for example, as shown on the right in FIG. 8C, the toner image Id (toner 37B) at 10% density is formed on the lowermost layer of the laminated toner image IL on the medium P.

The controller 200 sets the type of the medium P and the glossiness mode based on the initial setting information stored in the ROM 202, the input from the operation panel 204, or information included in the print data input from the information process apparatus 400. The controller 200 sets the fusing temperature Tt and the density $\alpha$ (0% or more and 100% or less) of the toner image Id (toner 37B) according to the set type of the medium P and the set type of the glossiness mode. The control part 200 corresponds to one specific example of the "control part" of the present invention. Specifically, the controller 200 fetches the fusing temperature Tt and the density $\alpha$ (0% or more and 100% or less) of the toner image Id (toner 37B) according to the set type of the medium P and the set type of the glossiness mode from the setting table 202A.

The controller 200 is configured such that, for example, when a thick paper is set as the medium P and the glossiness mode is set to normal, the fusing temperature Tt is set to a predetermined temperature (for example, temperature T2). The controller 200, for example, sets the density $\alpha$ of the toner image Id (toner 37B) to a predetermined density (e.g., 40%) when the fusing temperature Tt is set to a predetermined temperature (e.g., temperature T2). The density $\alpha$ of the toner image Id (toner 37B) corresponds to one specific example of the "amount of the second developer image (or amount of the second developer used for the second developer image)" of the present invention. The controller 200 is configured such that, for example, when a thick paper is set as the medium P and the glossiness mode is set to low, the fusing temperature Tt is set to a low temperature (e.g., temperature T1) lower than the temperature when the glossiness mode is set to normal (for example, temperature T2). The controller 200, for example, sets the density $\alpha$ of the toner image Id (toner 37B) to a density (e.g., 80%) higher than the density when the glossiness mode is set to low, when the fusing temperature Tt is set to a low temperature (e.g., temperature T1) lower than the temperature (e.g., temperature T2) when the glossiness mode is set to normal. "The density higher than the density when the glossiness mode is set to low" corresponds to one specific example of the "second amount that is more than the first amount" of the present invention.

The controller 200 outputs the set temperature Tt and the set density α of the toner image Id (toner 37B) to the process control part 300. The controller 200 outputs the density data Dd obtained from the concentration sensor 48 and the temperature data Dt obtained from the temperature sensor 53 to the process control part 300.

Next, the process control part 300 will be explained. The process control part 300, for example, includes a fusing control part 301, a motor control part 302, a high voltage control part 303, and an exposure control part 304. Further, the fusing control part 301 controls the heat source in the upper roller 51 such that the temperature of the upper roller 51 becomes the set fusing temperature Tt. The motor control part 302 controls the motor for rotating the photosensitive drum 31 and various rollers by being controlled by the controller 200. The high voltage control part 303 outputs the charged voltage, the development voltage, the supply voltage, the primary transfer voltage, and the secondary transfer voltage by being controlled by the controller 200. The high voltage control part 303 can be configured such that at least one of the voltages among the development voltage and the supply voltage is adjusted based on the density data Dd obtained from the concentration sensor 48 so that the thickness of the toner images Ib and Id becomes the targeted thickness.

The exposure control part 304 performs a data conversion of the print data input from the controller 200 and outputs the obtained exposure data to each of the LED heads 33 of the image forming units 30Y, 30M, 30C, and 30K. The exposure data, for example, includes the exposure area ratio and the exposure time prescribed in pixel unit. The exposure control part 304 further generates exposure data based on the density α of the toner image Id (toner 37B) input from the controller 200 and outputs the generated exposure data to the LED head 33 of the image forming unit 30CL.

The exposure control part 304, for example, can be configured to set the adjusting parameters based on the density data Dd obtained from the concentration sensor 48 such that the thicknesses of the toner images Ib and Id become the targeted thicknesses. The exposure control part 304, for example, can be configured to set the density of the toner images Ib and Id not for printing after the correction by the adjusting parameters to 100% and adjust the exposure area ratio and the exposure time in pixel units according to the print data.

[Operation]

Next, the printing operation of the image forming apparatus 1 will be explained. The controller 200 receives print data from the information process apparatus 400 connected to the image forming apparatus 1 (S101) and sets the type of the medium P and the glossiness mode based on the initial setting information fetched from the ROM 202, information input in the operation panel 204, and information included in the print data (S102). The controller 200 sets the fusing temperature Tt and the density of the toner 37B corresponding to the type and the glossiness mode of the set medium P. The controller 200 fetches the fusing temperature Tt and the density α of the toner 37B corresponding to the type and the glossiness mode of the set medium P from the setting table 202A.

The controller 200, for example, when the thick paper is set as the medium P and the glossiness mode is set to normal, sets the fusing temperature Tt to a predetermined temperature (for example, temperature T2). The controller 200, for example, sets the density α of the toner 37B to a predetermined density (e.g., 40%) when the fusing temperature Tt is set to a predetermined temperature (e.g., temperature T2). The controller 200, for example, when the thick paper is set as the medium P and the glossiness mode is set to low, sets the fusing temperature Tt to a low temperature (e.g., temperature T1) lower than the temperature when the glossiness mode is set to normal (for example, temperature T2). The controller 200, for example, sets the density α of the toner 37B to a density (e.g., 80%) higher than the density when the glossiness mode is set to low, when the fusing temperature Tt is set to a low temperature (e.g., temperature T1) lower than the temperature (e.g., temperature T2) when the glossiness mode is set to normal.

Next, the controller 200 transmits the fetched fusing temperature Tt and the density α of the toner 37B, and the print data to the process control part 300. The controller 200 further instructs the concentration sensor 48 to measure the density of the toner images Ib and Id not for printing.

The process control part 300 performs the density adjustment upon receipt of the print data from the controller. Specifically, the process control part 300 first instructs the image forming part 30 and the transfer part 40 to transfer the toner images Ib and Id not for printing to the transfer belt 41. With that, the image forming part 30 and the transfer part 40 transfer the toner images Ib and Id not for printing on the transfer belt 41. At this time, the concentration sensor 48 measures the density of the transferred toner images Ib and Id not for printing according to the instructions of the controller 200 to measure the density and outputs the density data Dd obtained from the measurement to the controller 200. The controller 200 outputs the density data Dd obtained from the concentration sensor 48 to the high voltage control part 303 and the exposure control part 304. When the density data Dd is input, the high voltage control part 303 adjusts at least one of the voltages among the development voltage and the supply voltage based on the density data Dd so that the thicknesses of the toner images Ib and Id become the targeted thicknesses. When the density data Dd is input, the exposure control part 304 sets the adjusting parameters thickness based on the density data Dd such that the thicknesses of the toner images Ib and Id become the targeted thicknesses. In this way, the process control part 300 performs the density adjustment.

Next, the process control part 300 performs the calculation of the densities of the toner images Ib and Id for printing (0% or more and 100% or less) (S103). Specifically, the process control part 300 instructs the exposure control part 304 to calculate the densities of the toner images Ib and Id for printing. Then, the exposure control part 304 calculates the density of the toner image Ib based on the received print data. Further, the exposure control part 304 sets the density α of the received toner image Id as the density of the toner image Ib. Further, the exposure control part 304 converts the calculated density of the toner image Ib to a ratio when the density of the toner image Ib not for printing is 100%, and generates exposure data corresponding to the received print data based on the ratio obtained by the conversion. Further, the exposure control part 304 converts the received density α of the toner image Id to a ratio when the density of the toner image Id not for printing is 100%, and generates exposure data corresponding to the toner image Id based on the ratio obtained by the conversion.

Further, the exposure control part 304 can correct the densities of the toner images Ib and Id not for printing according to the adjustment parameters. The exposure control part 304, for example, can correct the density of the toner image Ib not for printing according to the adjustment parameter, and convert the density of the calculated toner image Ib to a ratio when the density of the toner image Ib not for printing after the correction is 100%. Further, the exposure control part 304, for example, can correct the density of the toner image Id not for printing according to the adjustment parameter, and convert the density α of the received toner image Id to a ratio when the density of the toner image Id not for printing after the correction is 100%.

Next, the process control part 300 starts the printing operation (S104). First, the process control part 300 instructs the fuser part 50 to perform the temperature control of the upper roller 51. With that, the fuser part 50 controls the heat source in the upper roller 51 and sets the temperature of the upper roller 51 to the fusing temperature Tt (S105).

Next, the process control part 300 executes the transfer. First, the process control part 300 instructs the exposure control part 304 for the primary transfer based on the received print data. Then, the exposure control part 304 instructs at least one among the image forming units 30Y, 30M, 30C, and 30K to form the toner image Ib based on the received print data. As a result, the image forming unit that received the instruction forms the toner image Ib on the circumferential face 31A of the photosensitive drum 31, and the transfer part 40 transfers the toner image Ib on the circumferential face 31A to the transfer belt 41 (S106). Next, the process control part 300 determines whether or not the transfer of the toner image Id is necessary (S107). When the density of the toner image Id is 0%, the process control part 300 determines that the transfer of the toner image Id is not necessary (No at S107) and proceeds to the later explained Step S109. When the density of the toner image Id is more than 0%, the process control part 300 determines that the transfer of the toner image Id is necessary (Yes at S107) and transfer the toner image Id to the transfer belt 41 (S108). At this time, the process control part 300 instructs the exposure control part 304 to form the toner image Id. Then, the image forming unit 30CL forms the toner image Id on the circumferential face 31A of the photosensitive drum 31, and the transfer part 40 transfers the toner image Id on the circumferential face 31A to the transfer belt 41 (specifically, the surface of the toner image Ib on the transfer belt 41). In this way, the laminated toner image IL is formed on the transfer belt 41. Next, the process control part 300 instructs the fuser part 40 to perform the secondary transfer. With that, the transfer part 40 transfers the laminated toner image IL on the transfer belt 41 to the medium P (S109). In this way, the process control part 300 executes the transfer.

Next, the process control part 300 performs the fusing and the ejecting. First, the process control part 300 instructs the fuser part 50 to perform the fusing operation. Then, the fuser part 50 fuses the laminated toner image IL on the medium P by applying heat and pressure to the laminated toner image IL transferred on the medium P that passed through the transfer part 40 (S110). Next, the process control part 300 instructs the ejection part 60 to perform the ejection operation. With that, the ejection part 60 ejects the medium P to which the laminated toner image IL is fused to outside (S111). In this way, the printing operation of the image forming apparatus 1 is performed.

[Effects]

Next, the effects of the image forming apparatus 1 of this embodiment will be explained.

In a conventional image forming apparatus such as a printer, a photocopy apparatus, a facsimile apparatus, a multifunction device, etc., after a toner image is transferred on a medium being carried, the transferred toner image is heated and fused on the medium. The most suitable condition for fusing the toner image to the medium differs according to, for example, the type of the medium and the type of the glossiness mode. Therefore, when the medium is a thick paper or a film, or in a low glossiness mode, the toner image does not fuse firmly to the medium and may peel off from the medium. Further, when the medium is a film and set to a high glossiness mode, when the fusing temperature was set to a high temperature, the film may contract.

However, in the image forming apparatus 1 of this embodiment, the fusing temperature Tt and the density α of the toner 37B are set according to the type of the medium P. With this, for example, even when a thick paper with poor fusing performance or a film that is not strong against heat is selected as the medium P, a fusing temperature Tt and a density α of the toner 37B corresponding to the characteristics of the medium P can be selected. As a result, the peeling of the toner can be reduced. Further, in this embodiment, the softening temperature of the toner 37B is lower than the softening temperature of the toner 37A, and furthermore, the fusing temperature Tt and the density α of the toner 37B are set according to the type of the glossiness mode. With this, even when a mode in which a low temperature is required for the fusing temperature Tt is selected, peeling of the toner can be reduced since the toner 37B functions as an adhesive under layer to the toner 37A. Further, in this embodiment, even when a medium P with a poor fusing performance is selected, since there is no need to lower the printing speed, the occurrence of hot offset in which the toner 37A remains on the lower roller 52 can be prevented.

2. MODIFIED EXAMPLES

Hereinafter, a modified example of the image transfer apparatus 1 according to the aforementioned embodiment will be explained. Further, hereinafter, for structural elements in common with the aforementioned embodiments, the same symbols used for the aforementioned embodiments will be used. Furthermore, the structural elements different from the aforementioned embodiments will be mainly explained, and the explanations for structural elements in common with the aforementioned embodiment will be arbitrarily omitted.

Modified Example 1

In the aforementioned embodiment, the fusing temperature Tt and the density α of the toner 37B were selected according to the type of the medium P and the type of the glossiness mode. However, the fusing temperature Tt and the density α of the toner 37B can be set according to the type of the medium P. At this time, the setting table 202A, for example, as shown in FIG. 10, is configured such that the fusing temperature Tt and the density α of the toner 37B are set according to the type of the medium P. Even in such a case, for example, when a thick paper with poor fusing performance or a film that is not strong against heat is selected as the medium P, a fusing temperature Tt and a density α of the toner 37B corresponding to the characteristics of the medium P can be selected. As a result, peeling of the toner can be reduced.

Modified Example 2

In the aforementioned embodiment, the fusing temperature Tt and the density α of the toner 37B were selected according to the type of the medium P and the type of the glossiness mode. However, the fusing temperature Tt and the density α of the toner 37B can be set according to the type of the mode relating to the fusing temperature Tt (for example, type of the glossiness mode). At this time, in the setting table 202A, for example, as shown in FIG. 11, the fusing temperature Tt and the density α of the toner 37B are set according to the type of the mode relating to the fusing temperature Tt (for example, type of the glossiness mode).

In this modified example, the controller 200 is configured such that, for example, when the glossiness mode is set to normal, the fusing temperature Tt is set to a predetermined temperature (for example, temperature T2). The controller 200, for example, sets the density α of the toner 37B to a predetermined density (e.g., 40%) when the fusing temperature Tt is set to a predetermined temperature (e.g., temperature T2). The controller 200 is configured such that, for example, when the glossiness mode is set to low, the fusing temperature Tt is set to a low temperature (e.g., temperature T1) lower than the temperature when the glossiness mode is set to normal (for example, temperature T2). The controller 200, for example, sets the density α of the toner 37B to a high density (e.g., 80%) higher than the density when the glossiness mode is set to low, when the fusing temperature Tt is set to a low temperature (e.g., temperature T1) lower than the temperature (e.g., temperature T2) when the glossiness mode is set to normal.

In this modified example, the fusing temperature Tt and the density α of the toner 37B are set according to the type of the mode relating to the fusing temperature Tt (for example, type of the glossiness mode). With this, even when a mode in which a low temperature is required for the fusing temperature Tt is selected, peeling of the toner can be reduced since the toner 37B functions as an adhesive under layer to the toner 37A.

Modified Example 3

In the aforementioned Modified Example 2, the fusing temperature Tt and the density α of the toner 37B are set according to the type of the mode relating to the fusing temperature Tt (for example, type of the glossiness mode). However, the density α of the toner 37B can be set simply according to the fusing temperature Tt. At this time, the setting table 202A, for example, as shown in FIG. 12, is configured such that the density α of the toner 37B is set according to the fusing temperature Tt.

In this modified example, the controller 200, for example, sets the density α of the toner 37B to a predetermined density (e.g., 40%) when the fusing temperature Tt is set to a predetermined temperature (e.g., temperature T2). The controller 200, for example, when the fusing temperature Tt is set to a low temperature (e.g., temperature T1) that is lower than the temperature (e.g., temperature T2) when the density α of the toner 37B is set to a predetermined density (e.g., 40%), the density α of the toner 37B is set to a high density (e.g., 80%) higher than the density when the density α of the toner 37B is set to a predetermined density (e.g., 40%).

In this modified example, the density α of the toner 37B is set according to the fusing temperature Tt. With this, even when the fusing temperature Tt is set to a low temperature, peeling of the toner can be reduced since the toner 37B functions as an adhesive under layer to the toner 37A.

Modified Example 4

Figure 13:
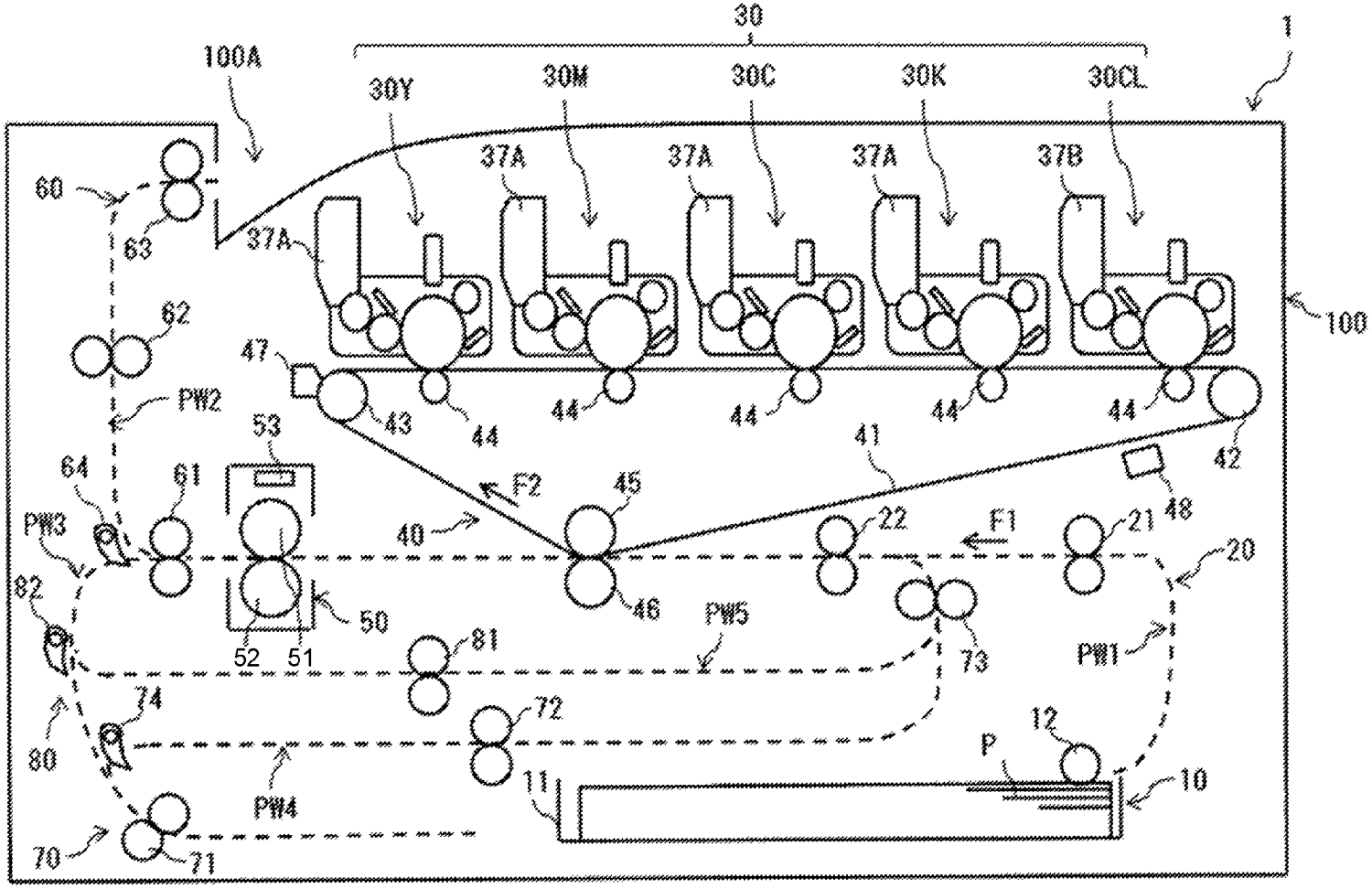
FIG. 13 is a schematic view showing one modified example of a schematic configuration of an image forming apparatus of FIG. 1.
Figure 14:
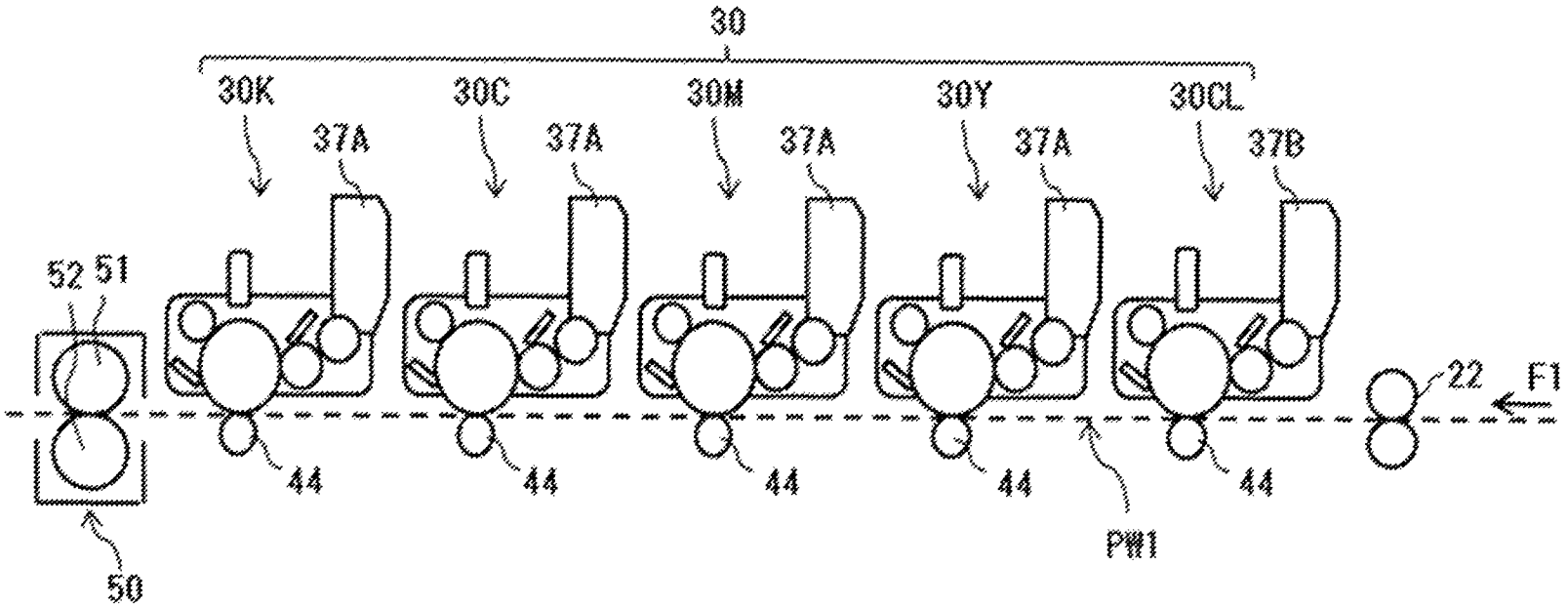
FIG. 14 is a diagram showing one modified example of the schematic configuration of the image forming part 30 and the transfer part 40 in the image forming apparatus of FIG. 1 and FIG. 13.

The aforementioned embodiment and the modified examples 1 to 3 can include a carrying path PW5 which bypasses the switching guide 74. The carrying path PW5 is a path for feeding the medium P to the carrying path PW1 or the carrying path PW4 without reversing the medium P. That is, the image transfer apparatus 1 of this modified example is equipped with a non-reverse part 80 for feeding the medium P to the carrying path PW1 or the carrying path PW4 without reversing it. The non-reverse part 80, for example, as shown in FIG. 13, includes a carrying roller 81 on the carrying path PW5, and includes a switching guide 82 at the linking portion of the carrying path PW5 and carrying path PW3 for assigning the medium P carried on the carrying path PW3 to either one of the carrying path PW5 and the carrying path PW3. Further, FIG. 13 exemplifies a manner in which the downstream of the carrying path PW5 is linked to a position in front of the carrying roller 73 on the carrying path PW4.

In this modified example, the transfer part 40, for example, after transferring the toner image Id on the medium P and before transferring the toner image Ib on the toner image Id, carries the medium P in which the toner image Id is transferred to the fuser part 50. The non-reverse part 80 feeds the medium P on which the toner image Id is transferred to the carrying path PW5 by the switching guide 82 and feeds it to the carrying path PW1 without reversing the medium P. Further, the transfer part 80 transfers the medium P to which the toner image Ib is transferred to the fuser part 50 after transferring the toner image Ib on the toner image Id on the medium P on which the toner Id is fused using the fuser part 60.

In this way, in the Modified Example, the toner image Ib is fused to the medium P after the toner image Id is fused to the medium P by using the non-reverse part 80. Therefore, in this modified example, the fuser part 60 can be configured so as to fuse the toner image Ib to the medium P at a temperature Ta (first fusing temperature) and fuse the toner image Id to the medium P at a temperature Tb (second fusing temperature) that is lower than the temperature Ta. Even in such a case, when a mode in which a low temperature is required for the fusing temperature Tt is selected, peeling of the toner can be reduced since the toner 37B functions as an adhesive under layer to the toner 37A.

Further, in this modified example, the softening temperature of the toner 37B does not have to be equal to the softening temperature of the toner 37A. In such a case, the fuser part 60 can be configured such that the toner image Ib and the toner image Id are fused to the medium P at the same fusing temperature Tt. Even in such a case, when a mode in which a low temperature is required for the fusing temperature Tt is selected, the toner 37B may function as an adhesive under layer to the toner 37A. At that time, the peeling of the toner can be reduced.

Modified Example 5

In the aforementioned embodiment and the modified examples 1 to 4, the image transfer was performed with indirect systems, but direct systems can be used. FIG. 13 shows one modified example of the schematic configuration of the image forming part 30 and the transfer part 40 in the image forming apparatus 1 according to the aforementioned embodiment and the Modified Examples 1 to 4. In this modified example, in the image forming apparatus 1 according to the aforementioned embodiment and the modified examples 1 to 4, the transfer belt 41, the drive roller 42, the tension roller 43, the opposing roller 45, the secondary transfer roller 46, and the cleaning member 47 are omitted, and a plurality of primary transfer rollers 44 are arranged on the carrying path W1. In this modified example, the image forming units 30Y, 30M, 30C, 30K, and 30CL are arranged in the order of the image forming unit 30CL, the image forming unit 30Y, the image forming unit 30M, the image forming unit 30C, and the image forming unit 30K, in the carrying direction F1. In this modified example, for example, a plurality of concentration sensors 48 are arranged one by one at positions facing the circumferential face 31A of each of the photosensitive drums 31. In this way, in this modified example, since only the image transfer method differs from the aforementioned embodiment and the modified examples 1 to 4, peeling of the toner can be reduced in a similar manner as the aforementioned embodiment and the modified examples 1 to 4.

Modified Example 6

Hereinafter, various variable examples will be explained.

In the aforementioned embodiment and the modified examples, four colors of image forming units 30Y, 30M, 30C, and 30K were used. However, in the aforementioned embodiment and the modified examples 1 to 4, for example, three or less colors or five or more colors of image forming units can be used. In the aforementioned embodiment and the modified examples 1 to 4, LED heads 33 were used. However, in the aforementioned embodiment and the modified examples, a laser element, etc., can be used instead of the LED head 33 or with the LED head 33.

The series of processes explained in the aforementioned embodiment and the modified examples can be performed by hardware (circuit) or software (program). When the aforementioned series of processes are performed by software, the software is constituted by a program group for executing each function by a computer. Each program can be, for example, integrated into the aforementioned computer in advance or used by being installed onto the aforementioned computer from a network or a recording medium.

In the aforementioned embodiment and the modified examples, an embodiment of the present invention was explained by exemplifying a color electrographic printer. However, the present invention is not limited to the application to a color machine or a printer, and is capable of being applied to image forming apparatuses in general for forming an image onto a carried medium. The present invention can be applied for, for example, a monochromatic copy machine, a color copy machine, a monochromatic MFP, a color MFP, etc.

As for the under layer, a white toner as well is available to form the layer.

What is claimed is:

1. An image forming apparatus, comprising:

a first image forming unit that forms a first developer image by using a first developer;

a second image forming unit that forms a second developer image by using a second developer, wherein a softening temperature of the second developer is lower than a softening temperature of the first developer;

a fuser part that fuses the first developer image and the second developer image on to a medium after the first developer image and the second developer image are laminated on to the medium, wherein the second developer image is laminated directly on to the medium;

a control part that controls an amount of the second developer used to form the second developer image; and a receiving part that receives information indicating a level of glossiness of the first developer image, the level of glossiness is selected based on a user input, wherein a first mode corresponds to a first level of glossiness and a second mode corresponds to a second level of glossiness that is higher than the first level of glossiness, and wherein when the first mode is received by the receiving part, the control part sets the amount of the second developer as a first value, when the second mode is received by the receiving part, the control part sets the amount of the second developer as a second value that is smaller than the first value and is larger than 0.

2. The image forming apparatus according to claim 1, wherein the second developer is a white toner.

3. The image forming apparatus according to claim 1, wherein the second developer is a clear toner.

4. The image forming apparatus according to claim 1, wherein the control part sets the amount of the second developer by setting a density of the second developer image.

5. The image forming apparatus according to claim 1, wherein when the first mode is received by the receiving part, the control part sets a fusing temperature of the fuser part as a third value, when the second mode is received by the receiving part, the control part sets the fusing temperature of the fuser part as a fourth value that is higher than the third value.

6. The image forming apparatus according to claim 1, wherein the receiving part receives a medium information indicating a type of the medium, the type of the medium is selected based on a user input, wherein the medium information is one of a first medium type or a second medium type;

wherein when the first mode is received by the receiving part and the medium information is the first medium type, the control part sets the amount of the second developer as a third value, when the first mode is received by the receiving part and the medium information is the second medium type, the control part sets the amount of the second developer as a fourth value, the third value is different from the fourth value, the third value and the fourth value are larger than the second value.

7. The image forming apparatus according to claim 6, wherein the first medium type is a thick paper, the second medium type is a film, the third value is larger than the fourth value.

8. The image forming apparatus according to claim 1, wherein a saturation of the second developer is lower than a saturation of the first developer.

9. The image forming apparatus according to claim 1, wherein a light-permeability of the second developer is higher than a light-permeability of the first developer.

10. The image forming apparatus according to claim 1, wherein the control part controls the second image forming unit to form the second developer image on the medium, then controls the fuser part to firstly fuse the formed second developer image to the medium, then controls the first image forming unit to form the first developer image on the medium to which the second developer image is fused, then controls the fuser part to secondly fuse the formed first developer image to the medium to which the second developer image is fused.

11. The image forming apparatus according to claim 10, wherein the control part sets a fusing temperature of firstly fusing of the fuser part as a third value, the control part sets a fusing temperature of secondly fusing of the fuser part as a fourth value that is higher than the third value.

12. An image forming apparatus, comprising:

a first image forming unit that forms a first developer image by using a first developer;

a second image forming unit that forms a second developer image by using a second developer, a softening temperature of the second developer is lower than a softening temperature of the first developer;

a fuser part that fuses the first developer image and the second developer image on to a medium after the first developer image and the second developer image are laminated on to the medium, wherein the second developer image is laminated directly on to the medium;

a control part that controls an amount of the second developer used to form the second developer image;

wherein the control part controls the second image forming unit to form the second developer image on the medium, wherein the control part controls the fuser part to firstly fuse the formed second developer image to the medium, wherein the control part controls the first image forming unit to form the first developer image on the medium to which the second developer image is fused, wherein the control part controls the fuser part to secondly fuse the formed first developer image to the medium to which the second developer image is fused, wherein when the fuser part firstly fuses the formed second developer image to the medium, the control part sets a fusing temperature as a first value, wherein when the fuser part secondly fuses the formed first developer image to the medium, the control part sets a fusing temperature as a second value that is higher than the first value.

* * * * *